United States Patent [19]

Giebel

[11] 4,322,863

[45] Apr. 6, 1982

[54] MACHINE FOR LASTING HEEL SEAT PORTIONS OF SHOES

[75] Inventor: Gerhard Giebel, Bad Soden, Fed. Rep. of Germany

[73] Assignee: USM Corporation, Farmington, Conn.

[21] Appl. No.: 170,690

[22] Filed: Jul. 21, 1980

[30] Foreign Application Priority Data

Jul. 20, 1979 [DE] Fed. Rep. of Germany ..... 2929536

[51] Int. Cl.[3] ..... A43D 21/00

[52] U.S. Cl. ..... 12/12.5

[58] Field of Search ..... 12/12.5, 8.7, 8.8, 10.5, 12/12.4, 14.4

[56] References Cited

U.S. PATENT DOCUMENTS 3,087,176 4/1963 Deschenes ..... 12/12.5

3,386,115 6/1968 McKibbin et al. ..... 12/12.5

3,444,571 5/1969 Harriman et al. ..... 12/12.5

*Primary Examiner*—Patrick D. Lawson

*Attorney, Agent, or Firm*—Donald N. Halgren

[57] ABSTRACT

In a tack seat lasting machine the wipers are moved lenthwise of the shoe and inwardly thereof under the action of a single piston-and-cylinder arrangement. For setting the appropriate "nail pattern", the action of said piston-and-cylinder arrangement is terminated by adjustable stroke limiting means, comprising a valve actuated by an abutment, the valve moving with the wipers and the abutment being adjustably positioned in the path of the valve. A further abutment, spaced from the first-mentioned abutment, controls the rest position of the wipers. The wipers are arranged symmetrically centrally of the machine, and the heel band is capable of clamping a shoe in the position in which it is presented by the operator, thereby avoiding the need to adjust the wiper for lefts and rights.

16 Claims, 3 Drawing Figures

MACHINE FOR LASTING HEEL SEAT PORTIONS OF SHOES

BACKGROUND OF THE INVENTION (1) Field of the Invention

This invention is concerned with a machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for wiping marginal portions of the shoe upper, at the heel seat region thereof, inwardly over, and pressing them against, corresponding marginal portions of the insole, and fastener inserting means effective to cause said lasting marginal portions to be secured, when pressed as aforesaid, to said corresponding marginal portions of the insole.

(2) Prior Art

In using a machine of the aforementioned type, it will be appreciated that the nail pattern, which is formed according to the relationship between the two rows of apertures formed in the wiper plates, and thus according to the end position assumed by the wiper plates after their lengthwise and in-wiping movement, has to be adjusted according to the size and style of shoe bottom being operated upon. In one known so-called tack seat lasting machine, in which the means for effecting movement of the wiper plates comprises cam means, rather than fluid pressure operated means, the position of the wiper plates fore-and-aft of the machine, after lengthwise and in-wiping movement thereof has been effected, is at a fixed datum of the machine so that, if it is desired to move the so-called "back tacks" (that is the most rearwardly located tacks of the nail pattern, which tacks are usually driven through apertures formed adjacent the pivot point of the wiper plates) relative to the shoe bottom, it is necessary to adjust the position of the heel band fore-and-aft of the machine. Similarly, in order to set the nail pattern according to the shoe bottom contour, in the aforementioned machine provision is made for adjusting each wiper plate about its pivot independently of the other wiper plate. In using said machine, furthermore, the heel band is generally effective to centralize the heel seat portion of the shoe bottom in the machine, that is to say to align a longitudinal center line of the heel seat region with a longitudinal center line of the heel band, and thus of the machine, so that, for left and right shoes, some adjustment of the nail pattern has to be made in order to compensate for the lack of symmetry of the heel seat region of the shoe bottom.

Thus, in the aforementioned machine, for any shoe style three separate adjustments have to be made, and further, where it is a question of changes of size within the style, two of said three adjustments again have to be made.

It has also been proposed, in a tack seat lasting machine, to provide a facility for adjusting the initial position of the wiper plates in relation to a shoe bottom, by pivoting them about their common pivot, according to the shoe bottom contour, the machine being so constructed and arranged that, in the operation thereof, the wipers are moved, in a direction extending lengthwise of the shoe bottom, through a fixed stroke, in-wiping movement of the wipers taking place in response to such lengthwise movement. Such adjustment of the wipers is achieved through a linkage by which in-wiping movement of the wipers takes place in response to lengthwise movement, so that firstly the connection between such linkage and the means for effecting lengthwise movement of the wipers is rendered more complicated, and further, since the wipers are caused to be moved through said linkage during such adjustment, the adjustment means itself must be sufficiently robust to enable the adjustment to be effected. Furthermore, in the course of a working day if a substantial amount of adjustment has to be made, this is not only time-consuming for the operator, but also may well be laborious for him.

Furthermore, in the last-mentioned machine, it is also proposed that the heel band will close on to the heel end of the shoe through the operation of a linkage arrangement which ensures that each "leg" of the heel band moves through the same distance, that is to say the heel band will centralize the heel end of the shoe in relation to the position of the heel band in the machine (which position is adjustable by varying the setting of said linkage arrangement).

Thus, in the case of this machine too it is necessary to set each wiper plate for the style and hand of shoe being operated upon, and it is further envisaged that the wiper plates will be adjustable as a pair of different sizes of shoe, while at the same time for each style and hand of shoe adjustment has to be made also to the heel band, not only lengthwise of the shoe bottom, but also widthwise thereof.

In yet another tack heel seat lasting machine which has been proposed, separate fluid pressure operated means are provided for moving the wiper assembly bodily in a direction extending lengthwise of the shoe bottom and for effecting in-wiping movement of the wiper plates, the arrangement being such that the end position of the wiper plates is determined by engagement of a leading edge of one of the wiper plates with a positive stop which is adjustably positioned according to the size of shoe being operated upon and further according to the width thereof. Such an arrangement, however, is effective to limit the lengthwise movement of the wiper assembly relative to the shoe bottom, rather than the widthwise movement thereof, and indeed cam means of said machine is so arranged that, following completion of the in-wiping movement, continued lengthwise movement of the wiper assembly can take place relative to the shoe bottom. Thus, in the operation of said machine, the provision of the stop member is more suited for ensuring that the so-called back tacks are in a correct position in relation to the lasting marginal portions of the shoe bottom, rather than for ensuring that the nail pattern as a whole is correctly positioned in relation thereto. Furthermore, since separate fluid pressure operated means are provided for the in-wiping and lengthwise movement, control of the lengthwise movement will not necessarily be effective also to control the amount of in-wiping movement of the wiper plates.

It is the object of the present invention to provide an improved machine for lasting heel seat portions of shoes, in the operation of which fasteners are inserted to secure lasting marginal portions of a shoe upper to corresponding marginal portions of an insole, in which machine the end position of the wiper plates, and thus of the apertures through which such fasteners are driven, can readily be set by operation of a single adjustment member by the operator, by means of which adjustment member both the lengthwise and in-wiping movement of the wiper plates is controlled.

BRIEF SUMMARY OF THE INVENTION

The invention thus provides a machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for wiping marginal portions of the shoe upper, at the heel seat region thereof, inwardly over, and pressing them against, corresponding marginal portions of the insole, and fastener inserting means effective to cause said lasting marginal portions to be secured, when pressed as aforesaid, to said corresponding marginal portions of the insole, wherein the wiper assembly includes a pair of wiper plates, fluid pressure operated means for effecting movement of the wiper plates in a direction extending lengthwise of the shoe bottom, and cam means effective, as such lengthwise movement is effected, to cause pivotal movement of the wiper plates to take place about an axis extending normally to the direction of lengthwise movement thus to cause the wiper plates to effect an in-wiping movement in relation to the shoe bottom, and further wherein each wiper plate has a row of apertures formed therein, adjacent a leading edge thereof, through which aperture fasteners can be driven by the fastener inserting means to secure the lasting marginal portions of the upper as aforesaid, the machine further comprising control means by which the operation of the fluid pressure operated means can be controlled, said control means comprising two co-operating abutment members, one of which is movable, under the action of the fluid pressure operated means, as lengthwise movement of the wiper plates is effected as aforesaid, from a position spaced from the other abutment member into engagment therewith, such engagement being effective to cause the action of the fluid pressure operated means to be terminated thereby causing the lengthwise movement of the wiper plates, and thus also the in-wiping movement thereof, to be arrested, and the control means further comprising adjustment means whereby, when the machine is in a rest condition, the distance between the abutment members can be varied thus to enable the position to which the wiper plates (and the apertures formed therein through which fasteners can be driven) are moved when lengthwise and in-wiping movement of said plates is subsequently effected as aforesaid to be set in a desired relationship with the shoe bottom.

By thus providing a facility for terminating the action of the fluid pressure operated means, it will be appreciated that the nail pattern provided by the wiper plates can readily be adjusted, by a single adjustment, according to the contour of the shoe bottom to be operated upon. It has been found, furthermore, that, over a size range, using the machine in accordance with the invention it is necessary merely to set the nail pattern according to the width of the shoe bottom being operated upon in the vicinity of the leading edge of the wiper plates for the nail pattern thus set to be accommodated to the shoe bottom contour, this being despite the fact that the "back tacks" position is no longer thereby set to a datum, which was considered a requisite in previous tack seat lasting machines. Thus, in using the machine in accordance with the invention, when the heel band and wipers have been initially set for a given style of shoe to be operated upon, it is only necessary, utilizing the single adjustment, to vary the nail pattern as aforesaid to cater for any size of shoe in that style. In addition, it is unnecessary to alter the nail pattern to accommodate left and right shoes.

In order to accommodate left and right shoes without adjustment, it is desirable that the heel band does not have a centralizing effect on the shoe, since it may be necessary to position the shoe offset from the longitudinal center line of the machine and of the heel band in order to locate it appropriately to the nail pattern which has been set. To this end, therefore, preferably in a machine in accordance with the invention heel band actuating means is provided for moving the "legs" of the heel band against opposite sides of the heel end of a shoe carried by the shoe support, thus to clamp the shoe thereon, said means comprising a pressure compensating arrangement whereby the pressure applied to the "legs" by said means is equalized. By equalizing the pressure, it will be appreciated, the tendency, which is visible in bands of previously available machines, to centralize the shoe on the longitudinal center line of the band is mitigated, and indeed the shoe can be clamped by the band in the position in which it is presented thereto by the operator.

More specifically, the heel band actuating means preferably comprises two lever arrangements acting one on each "leg" of the heel band, each lever arrangement being actuated by a wedge member movable relative thereto, and further the pressure compensating arrangement preferably comprises a piston-and-cylinder arrangement mounted between the two wedge members and effective to cause them to be moved relative to the lever arrangements. Thus, if, under the action of said piston-and-cylinder arrangement one "leg" of the heel band engages the shoe before the other "leg", no pressure build-up will be created at the point of contact until said other "leg" also is in engagement with the shoe, whereafter equal pressure will be applied to both sides. Conveniently, each lever arrangement comprises a first lever acting on the "leg" of the heel band and a second lever engageable by the wedge member, the two levers being pivoted on a common axis and adjustable stop means being provided for varying the angular relationship therebetween. In this way, in a machine setting-up operation, the rest condition of the heel band can be set.

As with available machines, the heel band can be readily released from its mounting in the machine and is arranged to be fixedly supported in the machine at its backseam region. In addition, in a machine in accordance with the invention two backing surfaces may provide additional support at opposite sides of the band adjacent the backseam region thereof. In this way, a band can firmly resist the pressure applied thereto by a shoe which is thrust into the band, without such backing surfaces having any centralizing effect on the shoe.

Where a significant change of style of shoe to be operated upon has to be catered for, it may be necessary to adjust the heel band position in relation to the wipers in a direction extending lengthwise of the shoe bottom. To this end, preferably the heel band and the actuating means therefore are mounted on a carrier for movement in a direction extending lengthwise of the shoe bottom, adjustment means being provided, operable under the control of the operator, for effecting such movement of the carrier.

With regard to the control means of the machine in accordance with the invention, the two abutment members are conveniently constituted by a switch device, e.g. a valve, operatively connected to the fluid pressure operated means, and an actuator for said device, by which a projecting spool portion of such valve can be engaged. Preferably, furthermore, the actuator comprises a stop member backed by resilient means, e.g. a so-called air spring, effective to cushion the impact between the two abutment members in the operation of the machine. Conveniently the movable abutment member is constituted by the switch device and the other member by the actuator.

Where the lengthwise, and thus the in-wiping, movement of the wiper plates is thus arrested by the action of the valve in controlling the operation of the fluid pressure operated means, conveniently the movable abutment member is carried on a piston rod of the fluid pressure operated means so that, by engagement with the other abutment member, a positive positioning of the piston rod, and thus also of the wiper plates, can be achieved.

It will be appreciated that either of the abutment members may be arranged to be moved under the action of the adjustment means of the control means, but preferably said adjustment means is effective to move said other abutment member relative to said one member, thus to vary the distance therebetween when the machine is in a rest condition. Furthermore, a further abutment member may be provided, arranged to be engaged by said movable abutment member as lengthwise movement of the wiper plates is effected in a return direction, thus to determine the rest position of the wiper assembly, and thus also to determine then overall stroke of the fluid pressure operated means in moving the wiper plates from their rest position to their position determined by engagement of said one and other abutment members. Conveniently, the further abutment member is also constituted by an actuator comprising a stop member backed by resilient means, e.g. a so-called air spring, said actuator being arranged, where said one abutment member is constituted by a valve, to engage an oppositely projecting spool portion thereof.

For the sake of convenience, the adjustment means by which the distance between said one and other abutment members can be set is also effective to move the further abutment member relative to said one abutment member. To this end, conveniently said other and said further abutment members are carried one on each "leg" of a U-shaped carrier mounted for sliding adjusting movement relative to said one abutment member when the machine is in a rest condition. It will thus be appreciated that, where such a U-shaped carrier is used, the effect of setting said carrier, and thus said other and said further abutment members, is to select, from the total stroke potential of the fluid pressure operated means, a stroke of predetermined length (determined by the distance between said other and said further abutment members) to be executed by the wiper assembly. In this way, the facility is provided for setting the end position of the wiper plate to provide a desired nail pattern, while at the same time ensuring that the stroke of the wiper assembly is not excessive.

BRIEF DESCRIPTION OF THE DRAWINGS

There now follows a detailed description, to be read with reference to the accompanying drawings, of one machine in accordance with the invention. It will be appreciated that this machine has been selected for description merely by way of exemplification of the invention and not by way of limitation thereof.

In the accompanying drawings.

DESCRIPTION OF THE PREFERRED EMBODIMENTS

Figure 1:
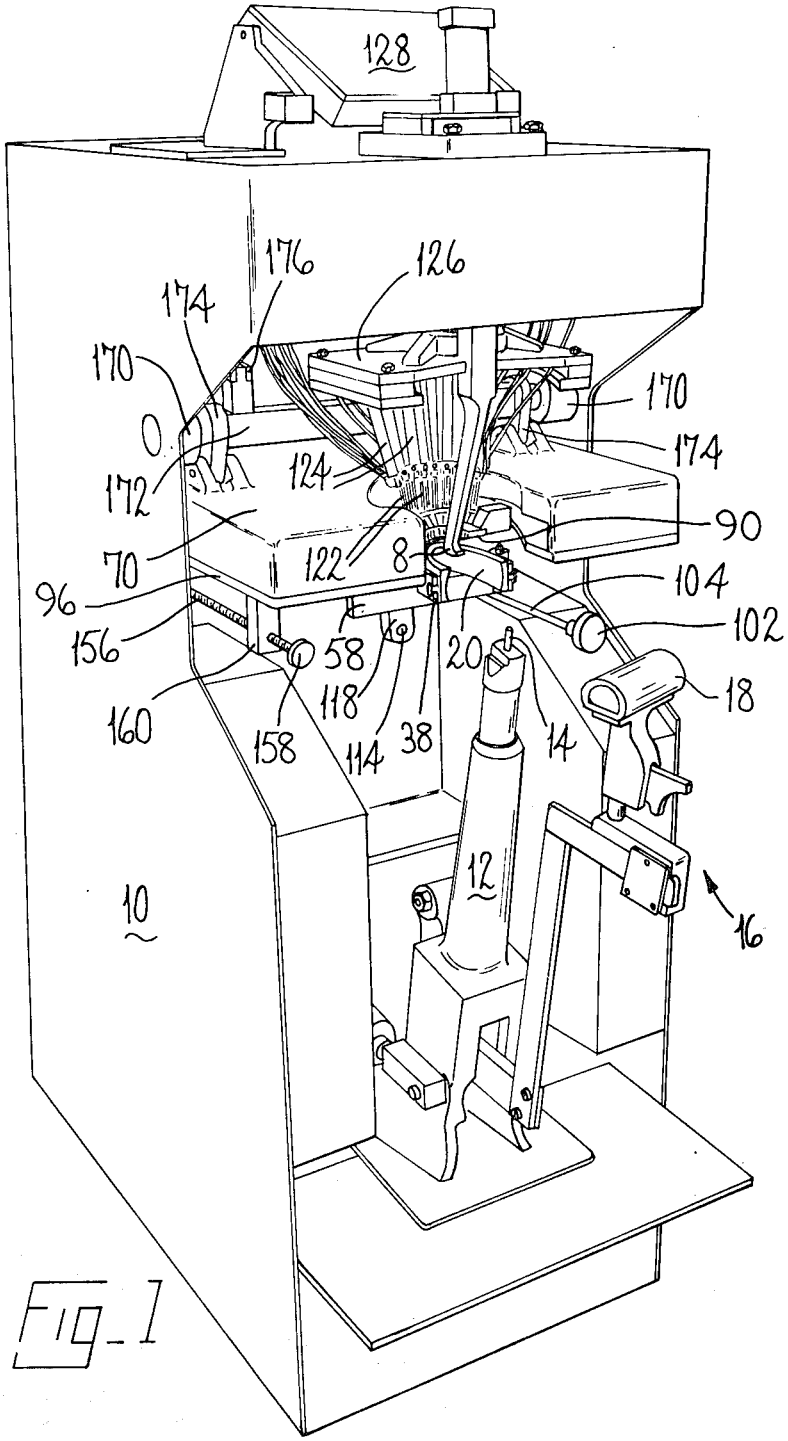
FIG. 1 is a front left-hand perspective view of the machine in accordance with the invention.
Figure 2:
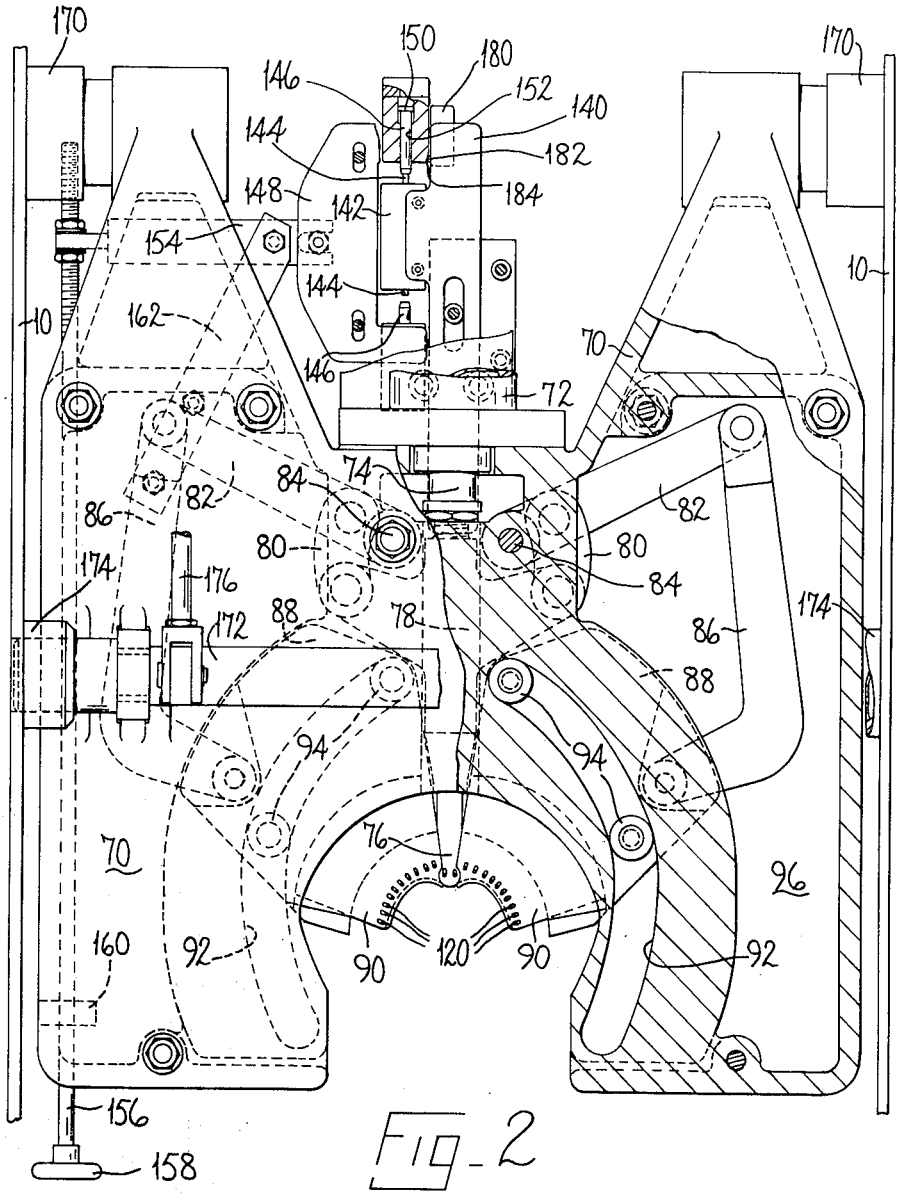
FIG. 2 is a fragmentary plan view showing details of a wiper assembly and of control means for controlling operation of fluid pressure operated means of said assembly.
Figure 3:
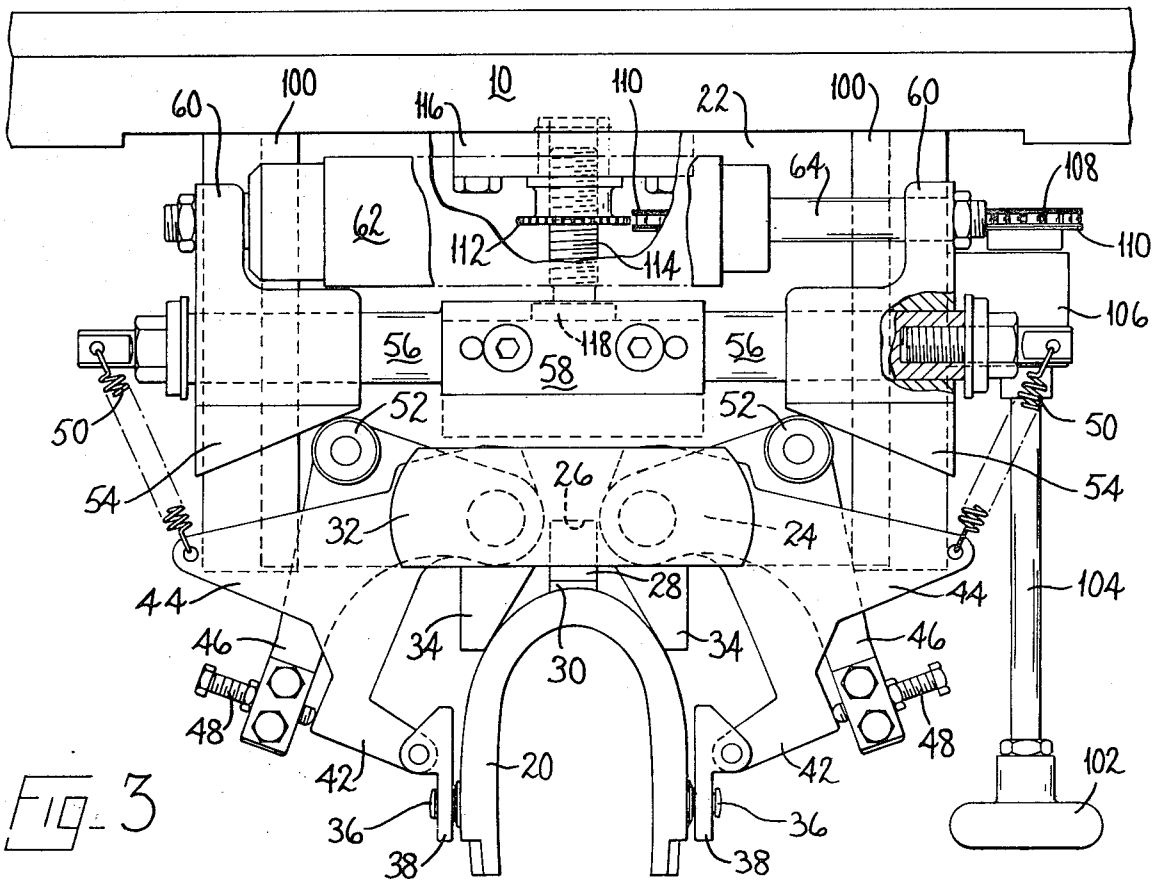
FIG. 3 is a fragmentary view showing a mounting for a heel band and actuating means therefor.

The machine in accordance with the invention is a machine for lasting heel seat portions of shoes using tacks and comprises a main frame 10 on which is supported, for pivotal movement about a horizontal axis, an upstanding shoe support 12 provided with a last pin 14 on which a last can be supported bottom uppermost. The last pin is capable of limited sideways movement on the shoe support. Also carried by the shoe support, for pivotal movement about an axis extending heightwise of the shoe support, is a toe support arrangement generally designated 16, including a toe pad 18 which is adjustable towards and away from the last pin 14, in order to accommodate different sizes of shoe.

When a shoe has been loaded on to the shoe support 12, pivotal movement of the latter is effective to carry the shoe, heel end first, into an operating position determined by a heel band 20 supported in the machine frame 10 by an arrangement now to be described. Said arrangement thus comprises a support plate 22 having bolted thereto a plate 24 having a cut-away portion to form a recess 26 for receiving a tab 28 forming part of a support bracket 30 to which the heel band is secured, said band thus being supported in the machine. Secured to the plate 24, through spacers (not shown) is a further plate 32, there being welded to forward edges of said plates 24, 32 two lugs 34 provided with inclined faces against which portions of the heel band adjacent and at opposite sides of the back seam region thereof can abut when the heel band is supported as aforesaid, such inclined faces forming a generally V-shape.

For urging the "legs" of the heel band into clamping engagement with a shoe, each "leg" has a stud 36 received in an open-ended slot of a presser plate 38 which is pivotally supported by a link 40 itself pivoted on a bracket 42 carried by a block 40 which is welded to a projecting portion 42 of a lever 44. Each 32, on one of the spacers, said spacers being arranged on opposite sides of the recess 26. Also mounted on each spacer is a further lever 46 which carries an adjustable stop member 48 arranged to engage with a portion of its associated lever 44, a spring 50 being provided for urging the lever 44 against said stop member. Each lever 46 also carries a roll 52 engageable with an inclined face provided by a wedge member 54, the wedge members 54 being mounted for sliding movement, widthwise of the machine, on a rod 56 secured at its center in a block 58 carried by the support plate 22. Each wedge member 54 has a rearwardly extending lug 60, there being connected to one of said lugs a cylinder 62 of a piston-and-cylinder arrangement and to the other of said lugs a piston rod 64 of said arrangement. The arrangement is double-acting.

Thus, in the operation of the heel band 20, actuation of the piston-and-cylinder arrangement causes the wedge members 54 to move towards one another thereby, through the rolls 52, causing the levers 46, and thus also the levers 44, to pivot to urge the "legs" of the heel band 20 clampingly to engage the shoe. By using a single piston-and-cylinder arrangement acting through the wedge members, a pressure compensating arrangement is thereby achieved in that if one of the "legs" of the heel band engages the shoe before the other, further movement of the wedge member associated with said one "leg" will be resisted, thereby causing the other wedge member to urge its associated "leg" into engagement with the shoe, whereafter the pressure on both "legs" will be equalized.

The effect of thus equalizing the pressure is to militate against any centralizing effect the heel band 20 may have on a shoe presented thereto. By the arrangement above described, it has been found that a shoe is clamped by the heel clamp in the position in which it is presented thereto by the operator.

The machine in accordance with the invention also comprises a wiping assembly by which lasting marginal portions of an upper can be wiped over and pressed against corresponding marginal portions of an insole of a shoe supported on the shoe support. The wiping assembly comprises a support casting 70 on which is carried a cylinder 72 of a piston-and-cylinder arrangement a forwardly projecting piston rod 74 of which carries a central wiper portion 76 for movement towards and away from the last pin 14. The piston rod 74 further supports a cross-piece 78 to which two links 80 are operatively connected, one at each end, each link being pivotally connected to a lever 82 which is mounted for pivotal movement on a pivot pin 84 carried by the support casting 70. Thus, as the piston rod 74 is moved as aforesaid, the levers 82 are caused to pivot, each about its pivot pin. Pivotally connected to the end, remote from the pivot pin, of each lever 82 is one end of a L-shaped link 86, the other end of which is in turn pivotally connected to a wiper carrier 88, each wiper carrier supporting a wiper plate 90. The wiper plates 90 are arranged one at either side of the central wiper portion 76 and from therewith a continuous wiping surface, the arrangement being such that the wiper plates are moved radially relative to said portion 76 thus to effect an in-wiping movement over the shoe bottom, as lengthwise movement under the action of the piston rod 74 takes place. To this end, there are formed in two upstanding bosses of the support casting 70 two radial slots 92, one associated with each wiper carrier, and further each wiper carrier 88 carries two rolls 94 accommodated in said slots. A cover plate 96 is secured to the casting 70 to enclose the wiper carriers and hold them in position. Thus, as the levers 82 are caused to pivot as aforesaid, they effect, through the links 86, a corresponding movement of the wiper carriers 88, and thus of the wiper plates 90, along the radial slots 92.

In using the machine in accordance with the invention, it may be desired to vary the fore-and-aft position of the heel band 20 relative to the wiper assembly, and to this end the support plate 22 of the heel band support arrangement is carried in slideways 100 secured on the main frame 10 of the machine. For varying the position of said plate in the slideways, a knob 102 is provided carried on a rotary shaft 104 captive in a block 106 connected to one of the slideways. A rearward end of the shaft carries a sprocket 108 connected by a chain 110 to a further sprocket 112 carried by a shaft 114 which is threadedly received in, and projects forwardly from, a block 116 secured to the main frame. A forward end of the shaft 114 is held captive in a block 118 secured to the underside of the block 58. Thus, rotation of the knob 102 is effective, through the sprockets and chain arrangement, to cause the block 58, and thus the heel band support arrangement, to be moved forwardly and rearwardly of the machine along the slideways 100.

For securing lasting marginal portions of an upper to corresponding marginal portions of an insole, using the machine in accordance with the invention, after said marginal portions have been pressed together as aforesaid, the wiper plates 90 and also the wiper portion 76 are provided with apertures 120 through which nails can be driven, the machine also comprising fastener inserting means for driving nails through said apertures. The fastener inserting means comprises a plurality of drivers 122 accommodated in housings 124 therefor carried by the wiper carriers 88 and the central wiper portion 76. For actuating the drivers 122, a single fluid pressure operated hammer plate 126 is provided (see FIG. 1). In addition, nail separator means generally designated 128 is provided on the machine frame 10 and feeds nails one at a time via tubes 130 to the driver housings 124. The fastener inserting means of the machine is generally conventional.

The apertures 120 determine the pattern in which the nails are inserted into the shoe bottom. For setting the nail pattern according to the shoe bottom being operated upon, using the machine in accordance with the invention, it is desired to vary the position to which the wiper plates 90 are moved as in-wiping movement thereof is effected as aforesaid. Since this in-wiping movement takes place in response to the lengthwise movement of the central wiper portion 76, under the action of the piston-and-cylinder arrangement (72, 74) for achieving control of the nail pattern the machine in accordance with the invention is provided with means for limiting the stroke of said piston-and-cylinder arrangement. To this end, said piston-and-cylinder arrangement comprises a further piston rod 140, extending rearwardly of the piston of said arrangement, on which piston rod is carried a first abutment member constituted by a switch device in the form of a valve 142 which is operatively connected to said piston-and-cylinder arrangement. The valve 142 has oppositely projecting spool portions 144 which are arranged to cooperate with further abutment members constituted by stop members in the form of plungers 146 mounted each on one "leg" of a U-shaped carrier 148, said plungers 146 thus constituting actuators for the valve 142. In order to reduce the impact arising when one of the spool portions 144 engages with its associated plunger 146, each plunger is carried on a piston 150 movable in a damping cylinder 152 carried by the carrier 148; thus, each plunger is backed by resilient means in the form of air spring.

In the operation of the machine, as lengthwise movement of the wiper portion 76 is effected, and thus in-wiping movement of the wiper plates 90 therewith, as aforesaid, the action of the piston-and-cylinder arrangement (which is double-acting) causing said movement to take place is terminated and said movement is arrested by actuation of the valve 142 when the appropriate spool portion 144 thereof engages its associated plunger 146. Furthermore, for adjusting the position to which the wiper plates 90 are moved under the action of said piston-and-cylinder arrangement, the position of the appropriate plunger 146 is adjustable, and to this end the U-shaped carrier 148 is mounted on the machine frame for sliding adjustment in a direction extending parallel to the movement of the piston rod 140. For this purpose, the carrier 148 has a laterally extending bracket 154 with a forwardly projecting threaded rod 156 on which is carried a knurled knob 158, said knob being captive in a bifurcated bracket 160 carried on the main frame of the machine. Thus, rotation of the knob 158 is effective to cause the rod 156, and thus the carrier 148 with the plungers 146 thereon, to be moved in said lengthwise direction. Alternatively, if desired, the knurled knob 158 and threaded rod 156 can be replaced by a slide rod mounted appropriately on the machine frame. In either case, preferably a graduated scale is provided to assist the operator in properly positioning the U-shaped carrier, and thus the plungers therewith.

By providing the plungers with an air spring backing, any adjustment of the U-shaped carrier can take place without physically re-positioning the wiper assembly; thus, where the adjustment of the carrier is in a direction to urge the one plunger, which is already engaging its associated spool portion, further towards said spool, said plunger can retract into its cylinder 152 during such adjusting movement. Nevertheless, on the next return stroke of said piston-and-cylinder arrangement, the action of said arrangement will be terminated by said plunger, now projecting from its cylinder in a normal manner, engaging its associated spool portion.

It will thus be appreciated that using the stroke limiting means just described, a limited stroke of the piston-and-cylinder arrangement by which the wiper assembly is actuated can be selected from the overall stroke potential of said piston-and-cylinder arrangement. Furthermore, by setting the appropriate plunger 146 to terminate the action of said piston-and-cylinder arrangement when the wiper plates have reached a desired position, and thus a desired nail pattern has been determined, the rest position of the wiper assembly is also determined, thereby ensuring that no excessive stroke between the final desired position and the rest position is utilized.

In using the machine in accordance with the invention, therefore, the operator is required to set a position to which the wiper plates are moved during their in-wiping movement, according to the desired nail pattern, regardless of the position of the so-called "back tacks" (position of which is determined by the position of the central wiper portion 76). Furthermore, once the heel band 20 has been positioned according to the style of shoe to be operated upon, any adjustment of the nail pattern required to accommodate different sizes of shoe within the range can be effected merely by adjusting the position of the carrier 148.

Again, no adjustment for lefts and rights is required, the wiper plates being arranged centrally of the machine and the heel band 20 being so actuatable that it clamps the shoe in the position in which the shoe is presented, without any centralizing effect, as already discussed above.

For applying bedding pressure to the shoe bottom through the wiper plates 90, after the lengthwise and in-wiping movement thereof is arrested, the support casting 70 is mounted, for pivotal movement about a horizontal axis, in two bearing blocks 170 carried by the main frame 10, the casting being supported, at an intermediate position, by a rod 172 accommodated in bearings 174 formed on the casting. The rod 172 is mounted for rotation, about an axis eccentric of its center, under the action of fluid pressure operated means (not shown) acting through a lever 176, rotation thereof thus being effective to urge the casting, and thus the wiper plates 90 and wiper portion 76 against the shoe bottom. As is conventional in tack seat lasting machines, the wiper plates 90 may also be heated, by cartridge heaters 178 carried on the wiper carriers 88, thus to improve the in-wiping and pressing action of the wiper plates.

Having thus described my invention and what I claim as new and desire to secure as Letters Patent of the United States is:

1. A machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for wiping marginal portions of the shoe upper, at the heel seat region thereof, inwardly over, and pressing them against, corresponding marginal portions of the insole, and fastener inserting means effective to cause said lasting marginal portions to be secured, when pressed as aforesaid, to said corresponding marginal portions of the insole, wherein the wiper assembly includes a pair of wiper plates, fluid pressure operated means for effecting movement of the wiper plates in a direction extending lengthwise of the shoe bottom, and cam means effective, as such lengthwise movement is effected, to cause pivotal movement of the wiper plates to take place about an axis extending normally to the direction of lengthwise movement thus to cause the wiper plates to effect an in-wiping movement in relation to the shoe bottom, and further wherein each wiper plate has a row of apertures formed therein, adjacent a leading edge thereof, through which apertures fasteners can be driven by the fastener inserting means to secure the lasting marginal portions of the upper as aforesaid, the machine further comprising control means by which the operation of the fluid pressure operated means can be controlled, said control means comprising two cooperating abutment members, one of which is movable, under the action of the fluid pressure operated means, as lengthwise movement of the wiper plates is effected as aforesaid, from a position spaced from the other abutment member into engagement therewith, such engagement being effective to cause the action of the fluid pressure operated means to be terminated thereby causing the lengthwise movement of the wiper plates, and thus also the in-wiping movement thereof, to be arrested and the control means further comprising adjustment means whereby, when the machine is in a rest condition, the distance between the abutment members can be varied thus to enable the position to which the wiper plates (and the apertures formed therein through which fasteners can be driven) are moved when lengthwise and in-wiping movement of said plates is subsequently effected as aforesaid to be set in a desired relationship with the shoe bottom.

2. A machine according to claim 1 wherein the two abutment members are constituted by a switch device operatively connected to the fluid pressure operated means and an actuator for said device.

3. A machine according to claim 2 wherein the switch device is constituted by a valve projecting spool portion of which is engaged by the actuator.

4. A machine according to either one of claims 2 and 3 wherein the actuator comprises a stop member backed by resilient means.

5. A machine according to any one of claims 2 to 4 wherein the movable abutment member is constituted by the switch device and the other member by said actuator.

6. A machine according to any one of the preceding claims wherein the movable abutment member is carried on a piston rod of the fluid pressure operated means.

7. A machine according to any one of the preceding claims wherein the adjustment means is effective to move said other abutment member relative to said one member thus to vary the distance therebetween when the machine is in a rest condition.

8. A machine according to any one of the preceding claims wherein a further abutment member is provided, arranged to be engaged by said movable abutment member as lengthwise movement of the wiper plates is effected in a return direction, thus to determine the rest position of the wiper assembly.

9. A machine according to claim 8 when tied through claim 5 to claim 3 wherein said further abutment member is constituted by an actuator comprising a stop member backed by resilient means, said actuator being arranged to engage an oppositely projecting portion of said valve.

10. A machine according to either one of claims 8 and 9 together with claim 7 wherein the adjustment means is also effective to move the further abutment member relative to said one abutment member.

11. A machine according to claim 10 wherein said other and said further abutment members are carried one on each "leg" of a U-shaped carrier mounted for sliding adjusting movement relative to said one abutment member when the machine is in a rest condition.

12. A machine according to any one of the preceding claims wherein heel band actuating means is provided for moving the "legs" of the heel band against opposite sides of the heel end of a shoe carried by the shoe support, thus to clamp the shoe thereon, said means comprising a pressure compensating arrangement whereby the pressure applied to the "legs" by said means is equalized.

13. A machine according to claim 12 wherein the heel band actuating means comprises two lever arrangements acting one on each "leg" of the heel band, each lever arrangement being actuated by a wedge member movable relative thereto, and wherein the pressure compensating arrangement comprises a piston-and-cylinder arrangement mounted between the two wedge members and effective to cause them to be moved relative to the lever arrangements.

14. A machine according to claim 13 wherein each lever arrangement comprises a first lever acting on the "leg" of the heel band and a second lever engageable by the wedge member, the two levers being pivoted on a common axis and adjustable stop means being provided for varying the angular relationship therebetween.

15. A machine according to any one of claims 12 to 14 wherein the heel band is fixedly supported at its backseam region and two backing surfaces provide additional support at opposite sides thereof adjacent the backseam region.

16. A machine according to any one of claims 12 to 15 wherein the heel band and the actuating means therefor are mounted on a carrier for movement in a direction extending lengthwise of the shoe bottom, adjustment means being provided, operable under the control of the operator, for effecting such movement of the carrier.

* * * * *

UNITED STATES PATENT OFFICE

CERTIFICATE OF CORRECTION

Patent No. 4,322,863 Dated April 6, 1982

Inventor(s) Gerhard Giebel

It is certified that error appears in the above-identified patent and that said Letters Patent are hereby corrected as shown below:

Column 11, Claim 9 - Line 28, before "portion" insert "spool"

Signed and Sealed this

Twenty-ninth Day of June 1982

[SEAL]

Attest:

GERALD J. MOSSINGHOFF

Attesting Officer

Commissioner of Patents and Trademarks